US005748481A

United States Patent [19]

Nakade

[11] Patent Number: 5,748,481

[45] Date of Patent: May 5, 1998

[54] DIAGNOSING METHOD OF YARN MONITOR AND APPARATUS THEREOF

[75] Inventor: Kazuhiko Nakade, Kyoto, Japan

[73] Assignee: Murata Kikai Kabushiki Kaisha, Kyoto, Japan

[21] Appl. No.: 230,742

[22] Filed: Apr. 21, 1994

[30] Foreign Application Priority Data

Apr. 27, 1993 [JP] Japan ..... 5-125294

[51] Int. Cl.[6] ..... G06F 19/00

[52] U.S. Cl. ..... 364/470.14; 364/470.15; 57/264; 73/160

[58] Field of Search ..... 364/469, 470, 364/552, 470.1, 470.14, 470.15; 73/160; 57/264, 265, 81; 340/677; 28/227; 66/163; 19/0.22, 0.23

[56] References Cited

U.S. PATENT DOCUMENTS 4,168,604 9/1979 Mannhart ..... 364/470
4,491,831 1/1985 Sakai et al. ..... 340/677
4,660,365 4/1987 Raasch ..... 57/263
4,924,406 5/1990 Bergamini et al. ..... 364/470
5,054,317 10/1991 Laubscher ..... 73/160
5,055,829 10/1991 Stuttem et al. ..... 340/677
5,423,169 6/1995 Hubert ..... 57/264

*Primary Examiner*—Reba I. Elmore
*Assistant Examiner*—Steven R. Garland
*Attorney, Agent, or Firm*—Armstrong, Westerman, Hattori, Mcleland & Naughton

[57] ABSTRACT

A diagnosing apparatus of a yarn monitor which continuously detects yarn diameter of each unit of a spinning machine comprising a number of spinning units, is provided with average value calculating means of yarn diameter, yarn evenness calculating means expressing average deviation of yarn diameter in ratio to average value of yarn diameter, and decision means for comparing the average value and the yarn evenness with that of other units and for outputting an abnormal signal when only the average value is different.

7 Claims, 5 Drawing Sheets

DIAGNOSING METHOD OF YARN MONITOR AND APPARATUS THEREOF

BACKGROUND OF THE INVENTION

1. Field of the Invention

The present invention relates to a diagnosing apparatus of a yarn monitor in a spinning machine or the like comprising a number of spinning units, and more particularly to an apparatus capable of finding gain errors of a yarn monitor.

2. Prior Art

A pneumatic spinning machine as one of a spinning machine comprising a number of spinning units, is disclosed, for example, in FIGS. 3 and 4 of JAPAN Laid Open No. 221427/1990. This pneumatic spinning machine will be described based on FIGS. 6 and 7. FIG. 7 is a diagram showing main part in each spinning unit. In FIG. 6, numeral 24 designates a back roller, numeral 25 designates a middle roller and numeral 26 designates a front roller, and an apron 27 being an endless rubber belt is wound on the middle roller 25. Each of the rollers 24, 25, 26 constituted by a top roller at upper side and a bottom roller at lower side, and carries out draft of a sliver S. An air jet nozzle 28 twists the sliver S getting out of the front roller 26, and a spinning yarn Y is manufactured. A delivery roller 29 draws a yarn from the spinning nozzle 28, and a yarn monitor 11 of photoelectric conversion type, i.e., a slub catcher detects variation of diameter (thickness) of the yarn Y and outputs a yarn unevenness signal. In addition, yarn speed is detected by a sensor 36 installed near the lower front roller 26*a*. The yarn speed is controlled by a master computer (not shown) in a spinning machine as a whole.

FIG. 7 is a detailed diagram of a yarn monitor. In FIG. 7, the yarn monitor, i.e., a slub catcher 11 comprises a light emission diode 30 and a photo transistor 31, and light quantity sent from the light emission diode 30 is detected by the photo transistor 31 and the detected light quantity is outputted as electric displacement between terminals. Thus the slub catcher 11 in such system is a detector of high sensitivity and high responsivity, and if the slub is encountered and displacement of quite large electric quantity is detected, a cutting device 32 acts by its output signal 37 and the yarn Y is cut at the position, and the electric signal 37 from the yarn monitor, i.e., the slub catcher 11 is also utilized as a yarn quality analyzing signal. In addition, in place of the slub catcher of optical type, that of static capacity type may be also used.

The yarn monitor 11 contains an amplifier (not shown) so that the gain adjustment and the zero point adjustment can be carried out. In some case, however, the zero point may be deviated, or the light receiving surface of the photo transistor 31 in FIG. 7 may be spoiled or the gain is decreased due to deterioration. Consequently, there is a problem that error is produced in analyzing the quality of yarn utilizing a signal from the yarn monitor 11.

SUMMARY OF THE INVENTION

In view of such a problem in the prior art, an object of the present invention is to provide a diagnosing method capable of finding abnormal state of a yarn monitor and an apparatus thereof.

A diagnosing method of a yarn monitor to solve the above-mentioned problems is provided with a plurality of yarn monitors, and each yarn monitor continuously monitors the supplied yarn and diagnosis of abnormal state of each yarn monitor is carried out at least in comparison with monitoring results in other plural yarn monitors.

Also an apparatus therefor is a diagnosing apparatus of a yarn monitor for continuously detecting yarn diameter of each unit of a spinning machine comprising a number of spinning units, and the diagnosing apparatus is provided with average value calculating means of yarn diameter, yarn evenness calculating means for expressing the average deviation of the yarn diameter in ratio to the yarn diameter, and decision means for comparing the average value and the yarn evenness with that of other unit and for outputting an abnormal signal only when the average value is different.

According to the above-mentioned constitution, when some yarn monitor is abnormal, the monitoring result becomes different from that by other monitor for monitoring the same kind of yarn. Also when the yarn is abnormal, the monitoring result becomes different, but decision can be effected that the yarn monitor is abnormal comparing variation of the yarn thickness, the symmetry of the yarn or the like.

DETAILED DESCRIPTION OF PREFERRED EMBODIMENT

Figure 1:
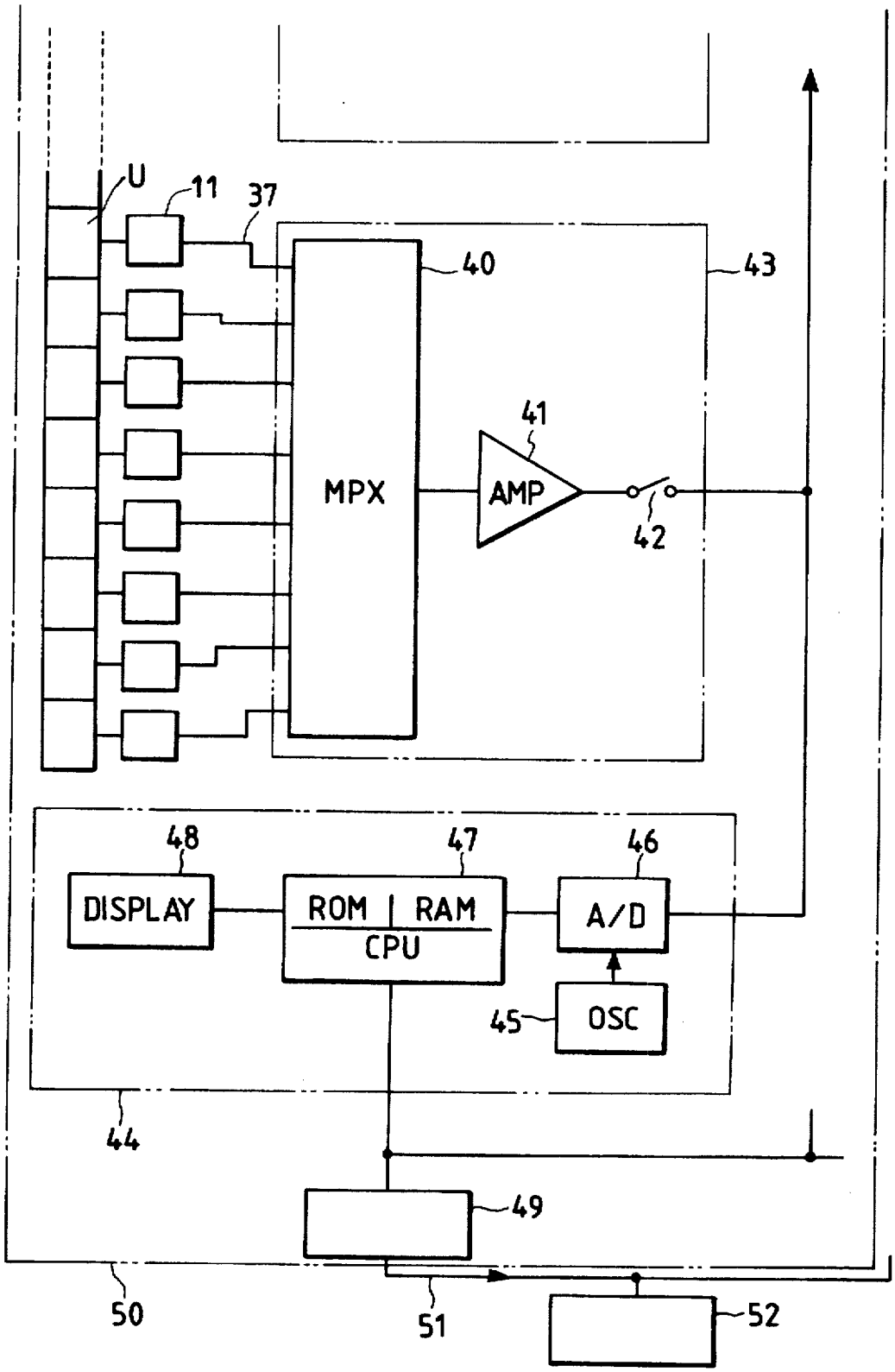
FIG. 1 is a wiring diagram showing constitution of a diagnosing apparatus of a yarn monitor of the invention.
Figure 2:
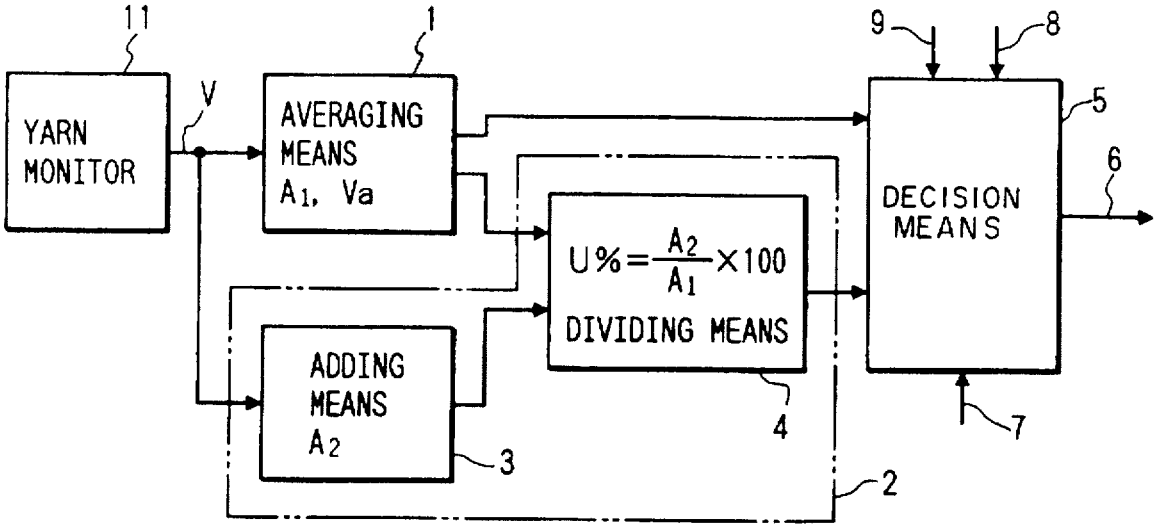
FIG. 2 is a functional block diagram of a diagnosing apparatus of a yarn monitor of the invention.
Figure 3:
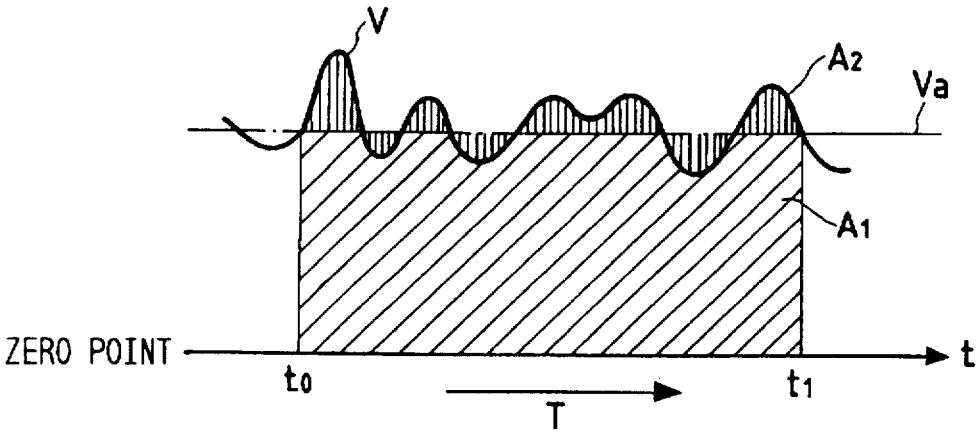
FIG. 3 is a diagram showing processing of a yarn diameter signal.
Figure 4:
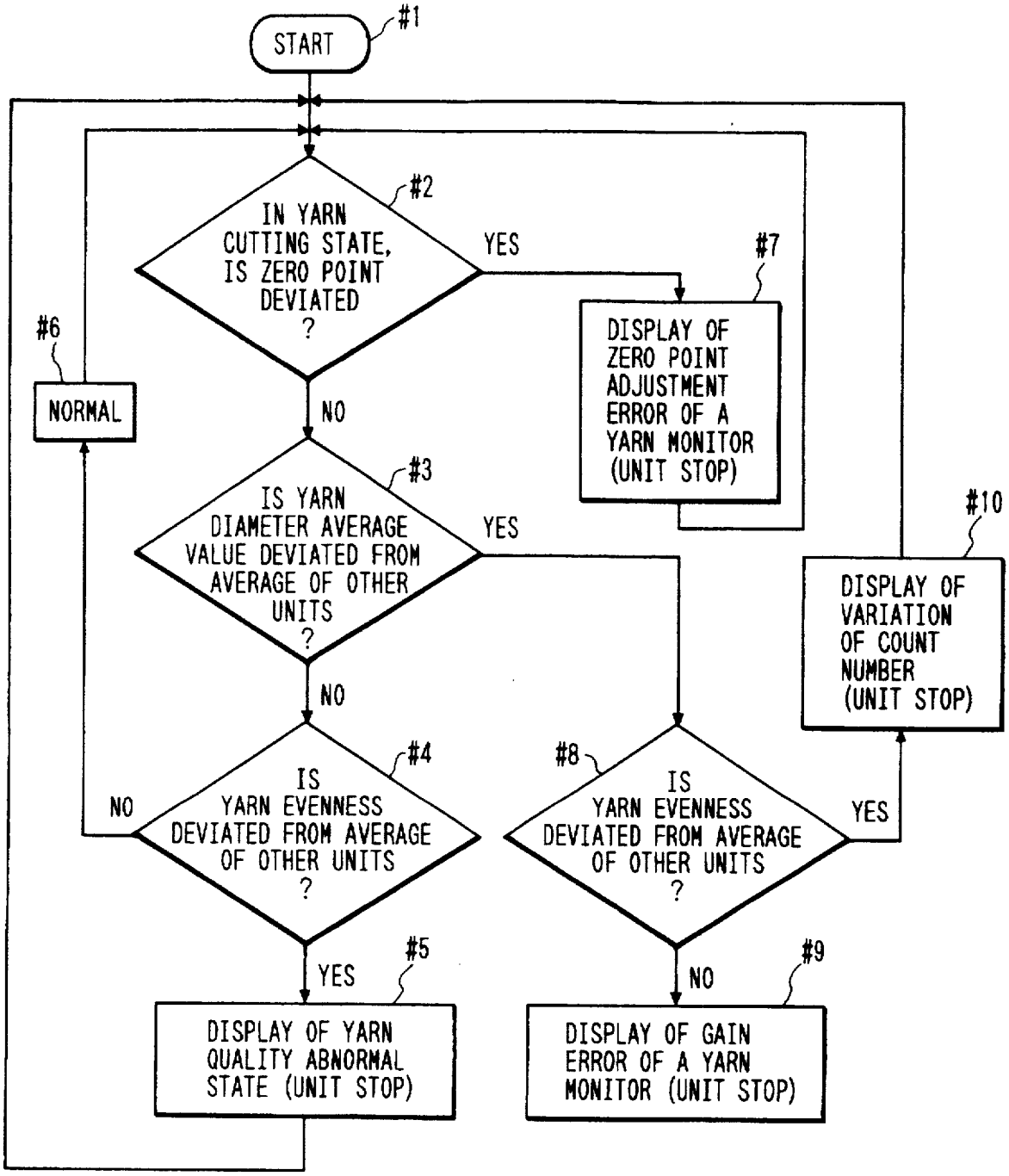
FIG. 4 is a flow chart showing operation of a diagnosing apparatus of a yarn monitor of the invention.
Figure 5:
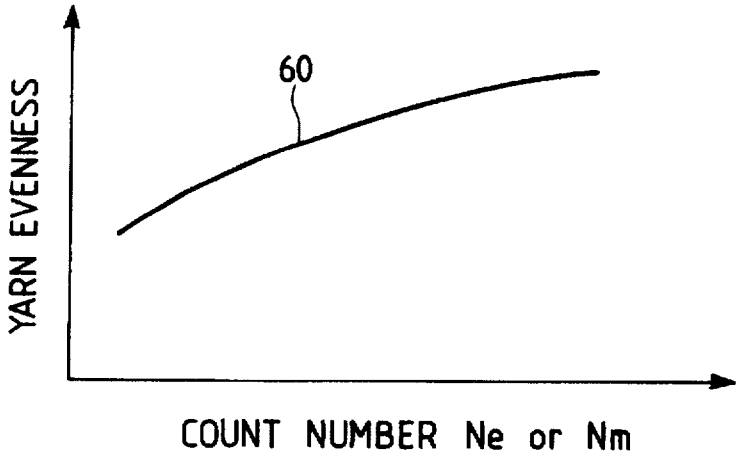
FIG. 5 is a diagram showing relation of the yarn evenness and the yarn thickness.
Figure 6:
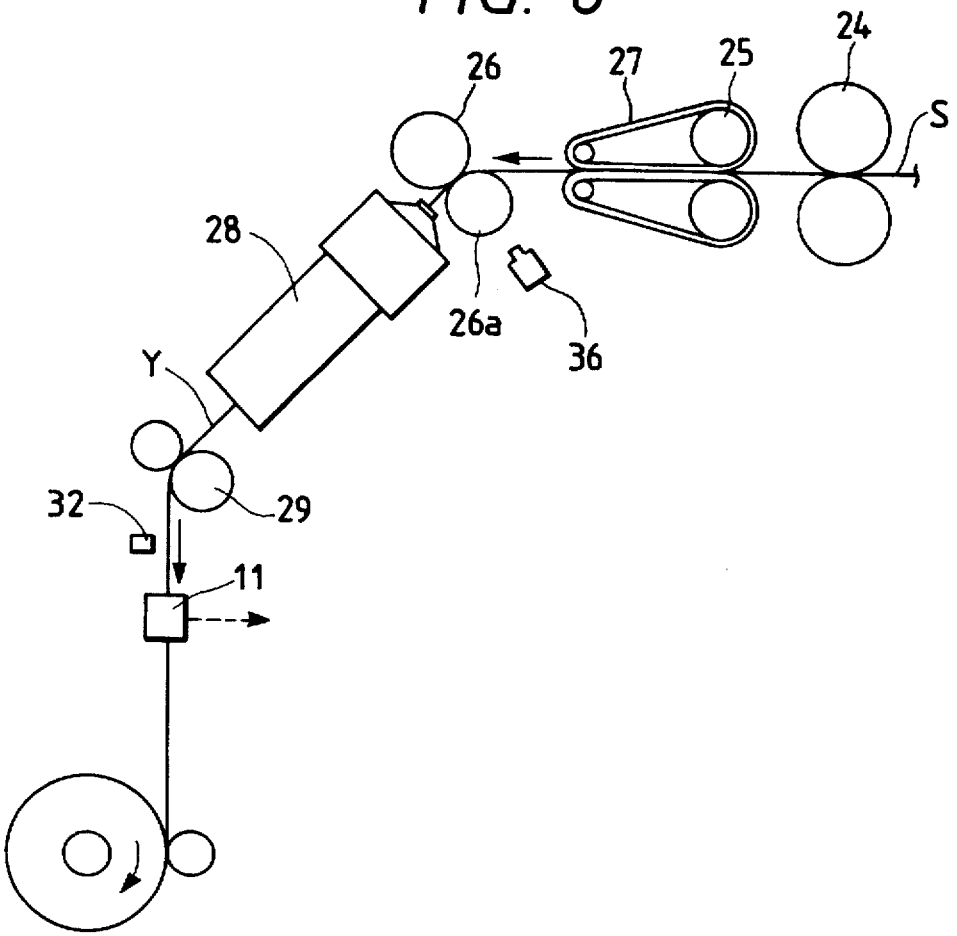
FIG. 6 PRIOR ART
FIG. 6 is a diagram showing main part in a spinning unit.
Figure 7:
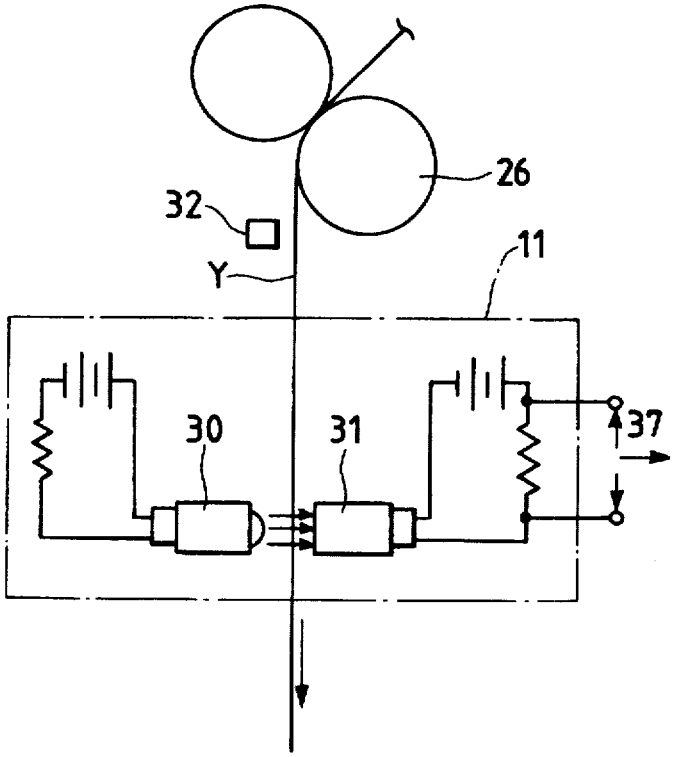
FIG. 7 PRIOR ART
FIG. 7 is a detailed diagram of a yarn monitor.

Embodiments of the present invention will be described referring to the accompanying drawings as follows. FIG. 1 is a wiring diagram showing constitution of a diagnosing apparatus of a yarn monitor of the invention, FIG. 2 is a functional block diagram of the diagnosing apparatus in FIG. 1, FIG. 3 is a diagram showing processing of a yarn diameter signal, FIG. 4 is a flow chart showing operation of the diagnosing apparatus in FIG. 1, and FIG. 5 is a diagram showing relation of the yarn evenness and the yarn thickness.

At first, constitution will be described based on FIG. 1. In FIG. 1, numeral 43 designates a slave installed per each span of a spinning machine described in the prior art, and numeral 44 designates a master of an analyzing apparatus installed commonly to a plurality of slaves 43. Analysis for each slave 43 is carried out in that changing means 42 is changed in sequence. An electric signal 37 from a yarn monitor 11 mounted on each spinning unit U belonging to the slave 43 is sent to a multiplexer 40, and is fetched in changing in sequence and amplified in an amplifier 41 and sent to the master 44. The electric signal sent to the master 44 is inputted to sampling means comprising an oscillator 45 and an A/D converter 46, where the signal is digitized and inputted to a master computer 47. The master computer 47 analyzes the electric signal, and if abnormal state is found, the abnormal state is displayed in a display 48, and the spinning unit U is stopped by a communication circuit (not shown) if necessary.

Also the master computer 47 is connected to a monitor computer 49 installed commonly for all master computers in a factory 50. The monitor 49 carries out display, storage and the like of data from the master computer 47, and the above-mentioned abnormal state is displayed in the monitor computer 49 and stored as data.

Further the monitor computer 49 is connected to a host computer 52 installed at a service center of a spinning machine maker by a telephone line 51. The host computer 52 processes and analyzes data from the monitor computer 49 and monitors all spinning units U individually, and for the above-mentioned abnormal state, advice is suitably given from the maker to the factory.

Next, operation content in the master computer will be described based on FIGS. 2 to 4. In FIG. 2, averaging means 1 receives and adds a detected signal (yarn diameter) V from a yarn monitor 11, and the signal is averaged and the added value $A_1$ and the average value $V_a$ of the yarn diameter are calculated. Adding means 3 receives and adds a difference between the signal V from the yarn monitor 11 and the average value $V_a$ of the yarn diameter, and calculates a deviation added value $A_2$. Dividing means 4 divides the deviation added value $A_2$ by the added value $A_1$ of the yarn diameter, and calculates the yarn evenness U%. The adding means 3 and the dividing means 4 constitute yarn evenness calculating means 2. Decision means compares the average value $V_a$ of the yarn diameter and the yarn evenness U% with an average value signal 8 of yarn diameter and a yarn evenness signal 9 inputted from other units (not shown) and effects decision, and outputs a signal of abnormal, normal or the like. A yarn breaking signal 7 from a yarn breaking detector (not shown) is also inputted to the decision means 5, and a decision based on this is also effected.

FIG. 3 shows a diagram showing processing of the yarn diameter signal. In FIG. 3, if the yarn diameter V is added in a definite time interval T(=time to—time $t_1$), added value $A_1$ (range with oblique lines) is obtained, and if this is divided by the data number, average value $V_a$ is calculated. For example, if there are ten data within the range T, the added value $A_1$ l is obtained by adding up the value of yarn diameter V of the ten data and the average value $V_1$ is obtained by dividing the added value $A_1$ by ten. If a difference between the V and the yarn diameter average value $V_a$ is added, the deviation added value $A_2$(range with vertical lines) is calculated. The area of the ranges which are greater than the average value $V_a$ of the deviation added value $A_2$, and the area of the range which are lower than the average value $V_a$ are equal. If the deviation added value $A_2$ is divided by the added value $A_1$ and multiplied by 100, the yarn evenness U% is calculated. Since the deviation added value $A_2$ divided by the data number is the average deviation of the yarn diameter, the yarn evenness U% is expressed by percentage of the average deviation of the yarn diameter to the average value $V_a$ of the yarn diameter.

In this case, if the gain of the yarn monitor is deviated, since the amount of the signal value V of the yarn diameter is varied and the signal value V is amplified some times over, the average value $V_a$ is varied, but since the yarn evenness U% is a ratio of the average value $V_a$ and the average deviation, it is not varied. Also when the count number of the yarn is varied, the yarn evenness is gradually decreased or increased with thickness of the yarn as shown in curve 60 of FIG. 5. Consequently, both the average value $V_a$ and the yarn evenness U% are varied. Also when the yarn quality is varied, since the average deviation of the yarn diameter is varied, the yarn evenness U% is varied and the average value $V_a$ is not varied. Consequently, if the average value $V_a$ of the yarn diameter and the yarn evenness U% are compared with the average value signal 8 of the yarn diameter and the yarn evenness signal 9 inputted from other plural units of FIG. 2, the gain error of the yarn monitor can be detected. Also if the yarn breaking state is known using the yarn breaking signal 7 of FIG. 2, when the yarn diameter signal V is outputted in that state, decision can be effected that the zero point of the yarn monitor is deviated.

Next, decision processing of the decision means 5 in FIG. 2, that is, operation of the diagnosing apparatus will be described based on FIG. 4. In FIG. 4, if the diagnosing apparatus is started (step #1), at first, by the yarn breaking signal and the yarn diameter average value in a certain yarn monitor 11, it is confirmed whether or not the zero point is deviated in the yarn breaking state (step #2). If the zero point is deviated, that is, out of the allowable range, the zero point adjustment error of the yarn monitor is displayed (step #7). If the zero point is not deviated, that is, within the allowable range, it is confirmed whether or not the yarn diameter average value in the yarn monitor 11 is deviated from the average of other plural units (step #3). If the average value is deviated, that is, out of the allowable range, process advances to step #8, and it is confirmed whether or not the yarn evenness in the yarn monitor 11 is deviated from the average of other plural units. If the yarn evenness is deviated, that is, out of the allowable range, decision of the count number variation of the yarn (a yarn of different count number is spun) or change of yarn kind is effected and this is displayed (step #10). If the yarn evenness is not deviated, that is, within the allowable range, decision of the gain error of the yarn monitor 11 is effected and this is displayed (step #9).

In step #3, if the yarn diameter average value is not deviated from the average of other plural units, that is, within the allowable range, process advances to step #4 and it is confirmed whether or not the yarn evenness is deviated from the average of other plural units. If the yarn evenness is deviated, that is, out of the allowable range, decision of the abnormal quality of the yarn is effected and this is displayed (step #5). If the yarn evenness is not deviated, that is, within the allowable range, normal state is displayed (step #9) and operation is continued. In addition, when the display is carried out in steps #5, #7, #9, #10, unit corresponding to the yarn monitor 11 may be stopped.

Consequently, in the above-mentioned diagnosing apparatus of the yarn monitor, if the gain is decreased due to spoiling of the light receiving surface, the circuit fault or deterioration, the gain error is displayed and the spinning unit is stopped. Thereby producing of error can be prevented in analyzing the yarn quality, and since a signal for analyzing the yarn quality is utilized, a number of yarn monitors can be diagnosed in concentration at one place.

Also as shown in FIG. 1, information from the diagnosing apparatus of the yarn monitor is transmitted to the host computer 52 installed at the service center of the spinning machine maker by the telephone line 51, and for the abnormal state such as gain error, advice is suitably given from the maker to the factory.

In the above-mentioned embodiment, the case of applying the present invention to a pneumatic spinning machine has been described, but in other case, for example, in the case of an automatic winder, a winding unit displaces the spinning unit in FIG. 1 and the present invention can be applied similarly. Further, the present invention can be applied to a ring spinning machine, a yarn combining machine or the like. Also in the description of the above-mentioned embodiment, the symmetry may use CV% (Coefficient of Variation) in place of U% (Irregularity). In steps #3, #4, #8, the average of other plural units includes meaning of the average of other two selected units and meaning of the average of all other units. Further, the average including the diagnosis object will do. The meaning of the average is broadly interpreted in the meaning of tendency.

In a diagnosing method of a yarn monitor and an apparatus thereof in the present invention as above described, since the average value of yarn diameter and the yarn evenness are calculated from output of the yarn monitor and compared with that of other units, and an abnormal signal is outputted when only the average value is different, the gain error of the yarn monitor can be found and a number of yarn monitors can be diagnosed in concentration.

What is claimed is:

1. A diagnosing method of a yarn monitor comprising the steps of:

providing a plurality of yarn monitors;

having each yarn monitor monitor a supplied yarn and provide monitoring results;

carrying out an abnormal state diagnosis by comparing the monitoring results of one of said plurality of varn monitors with the monitoring results of other yarn monitors, wherein the abnormal state of each yarn monitor is diagnosed by the following items (1)–(3), (1) whether or not a zero point is deviated in a yarn breaking state;

(2) whether or not a yarn diameter average value is deviated from that of at least one of said other yarn monitors; and (3) whether or not a yarn evenness is deviated from that of at least one of said other yarn monitors.

2. A diagnosing method of a yarn monitor, comprising the steps of:

providing a plurality of yarn monitors;

having each yarn monitor monitor a supplied yarn and provide monitoring results;

carrying out an abnormal state diagnosis by comparing the monitoring results of one of said plurality of yarn monitors with the monitoring results of other yarn monitors.

wherein the abnormal state of each yarn monitor is diagnosed by the following items (1)–(3), (1) whether or not a zero point is deviated in a yarn breaking state;

(2) whether or not a yarn diameter average value is deviated from the average of yarn diameter average values of a plurality of said other yarn monitors; and (3) whether or not a yarn evenness is deviated from an average of the yarn evenness of a plurality of said other yarn monitors.

3. A diagnosing apparatus for a yarn monitor which is installed in each unit of a yarn handling machine comprising a number of yarn handling units, said diagnosing apparatus comprising:

average value calculating means of yarn diameter for calculating an average value based on a detected signal from the respective yarn monitor;

yarn evenness calculating means expressing deviation added value of yarn diameter in ratio to the yarn diameter average value; and decision means for comparing the yarn diameter average and the yarn evenness between that of a diagnosis object one of the yarn handling units and that, of other units and for outputting an abnormal signal only when the yarn diameter average value is different.

4. A diagnosis apparatus of a yarn monitor according to claim 3, comprising warning means for warning the abnormal state of the yarn monitor.

5. A diagnosing method of a yarn monitor comprising the steps of:

providing a yarn monitor;

having the yarn monitor a supplied yarn and provide a monitoring result;

analyzing the monitoring result from the yarn monitor;

identifying data which varies in relation to a condition of said yarn monitor and is yarn diameter average value data and data which does not vary in relation to a condition of said yarn monitor and is yarn evenness data; and indicating that an abnormality exists in said yarn monitor only in the case of said data which varies in relation to a condition of said yarn monitor.

6. A diagnosing method of a yarn monitor, comprising the steps of:

providing a plurality of yarn monitors;

having said yarn monitors monitor a supplied yarn and provide monitoring results via detection signals;

obtaining a yarn diameter average value and a yarn evenness by processing the detection signal from one of said yarn monitors, and judging that said one of said yarn monitors itself is abnormal in a case that the yarn diameter average value is abnormal and the yarn evenness is normal.

7. A diagnosing method according to claim 6, wherein the data which is obtained by said one of said yarn monitors and is processed, is compared with the processed data which is obtained from others of said plurality of yarn monitors to judge a state of said one of said yarn monitors.

* * * * *